US006964415B2

(12) United States Patent
Schnitman et al.

(10) Patent No.: US 6,964,415 B2
(45) Date of Patent: Nov. 15, 2005

(54) DICE GAME

(76) Inventors: Marissa Schnitman, 222 Hilgard Ave., Los Angeles, CA (US) 90024; Annabelle Schnitman, 5371 Punta Alta Unit 2E, Laguna Hills, CA (US) 92653-2582

( * ) Notice: Subject to any disclaimer, the term of this patent is extended or adjusted under 35 U.S.C. 154(b) by 318 days.

(21) Appl. No.: 10/445,978

(22) Filed: May 27, 2003

(65) Prior Publication Data

US 2004/0239028 A1 Dec. 2, 2004

(51) Int. Cl.[7] ..... A63F 9/04

(52) U.S. Cl. ..... 273/146; 273/274; 273/309; 273/148 R

(58) Field of Search ..... 273/146, 274, 273/148 R, 309

(56) References Cited

U.S. PATENT DOCUMENTS 3,463,496 A * 8/1969 Weinstein et al. ..... 273/246
3,560,127 A * 2/1971 Imperato ..... 273/246
3,652,086 A * 3/1972 Stecker ..... 273/292
3,892,410 A * 7/1975 Hoetzel ..... 273/145 C
4,648,602 A * 3/1987 Maroney ..... 273/146
4,729,568 A * 3/1988 Welsh ..... 273/246
4,881,740 A * 11/1989 Odhner ..... 273/248
4,917,386 A * 4/1990 Tozer ..... 273/246
4,930,780 A * 6/1990 Goodman et al. ..... 273/146
4,961,581 A * 10/1990 Barnes et al. ..... 273/236
4,986,546 A * 1/1991 Cerulla ..... 273/240
5,011,160 A * 4/1991 Lacza ..... 273/268
5,031,915 A * 7/1991 Sanditen ..... 273/146
5,133,559 A * 7/1992 Page ..... 273/274
5,374,066 A * 12/1994 Ali ..... 273/279
5,542,671 A * 8/1996 Stewart ..... 273/146
5,732,948 A * 3/1998 Yoseloff ..... 273/274
5,791,651 A * 8/1998 Bryant ..... 273/274
5,884,915 A * 3/1999 Koziol ..... 273/245
5,934,673 A * 8/1999 Telarico et al. ..... 273/246
5,964,463 A * 10/1999 Moore, Jr. ..... 273/274
6,209,874 B1 * 4/2001 Jones ..... 273/274
6,213,876 B1 * 4/2001 Moore, Jr. ..... 463/22
6,273,423 B1 * 8/2001 Promutico ..... 273/274
6,336,633 B1 * 1/2002 Webb ..... 273/274
6,471,209 B1 * 10/2002 Barshinger ..... 273/246
6,508,469 B2 * 1/2003 Promutico ..... 273/274
6,543,768 B1 * 4/2003 Kuzel ..... 273/146
6,601,848 B1 * 8/2003 Timmons, Sr. ..... 273/146
2001/0034264 A1 * 10/2001 Berman et al. ..... 463/22
2003/0062672 A1 * 4/2003 Sloper ..... 273/146
2003/0085515 A1 * 5/2003 Yu et al. ..... 273/146
2003/0168806 A1 * 9/2003 Nigale ..... 273/283
2003/0193137 A1 * 10/2003 Kennedy ..... 273/146
2003/0218300 A1 * 11/2003 Timmons ..... 273/146
2004/0041342 A1 * 3/2004 Frieman ..... 273/146
2004/0046319 A1 * 3/2004 Merritt ..... 273/236

* cited by examiner

*Primary Examiner*—Derris H. Banks
*Assistant Examiner*—Dolores Collins
(74) *Attorney, Agent, or Firm*—Clement Cheng

(57) ABSTRACT

A dice game uses six-sided die. The object of the game is achieved with random dice rolls and is a game of chance. The simplicity of the game requires only numerical recognition of the values 1 to 6. Since no other prior knowledge is required, this game effectively eliminates the age and knowledge gap among players, hence creating an unbiased starting point for players of different age ranges.

6 Claims, 1 Drawing Sheet

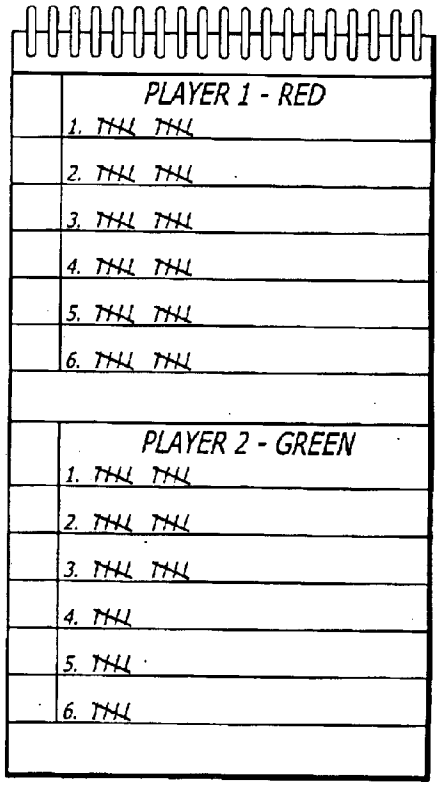
FIG. 2
FIG. 1
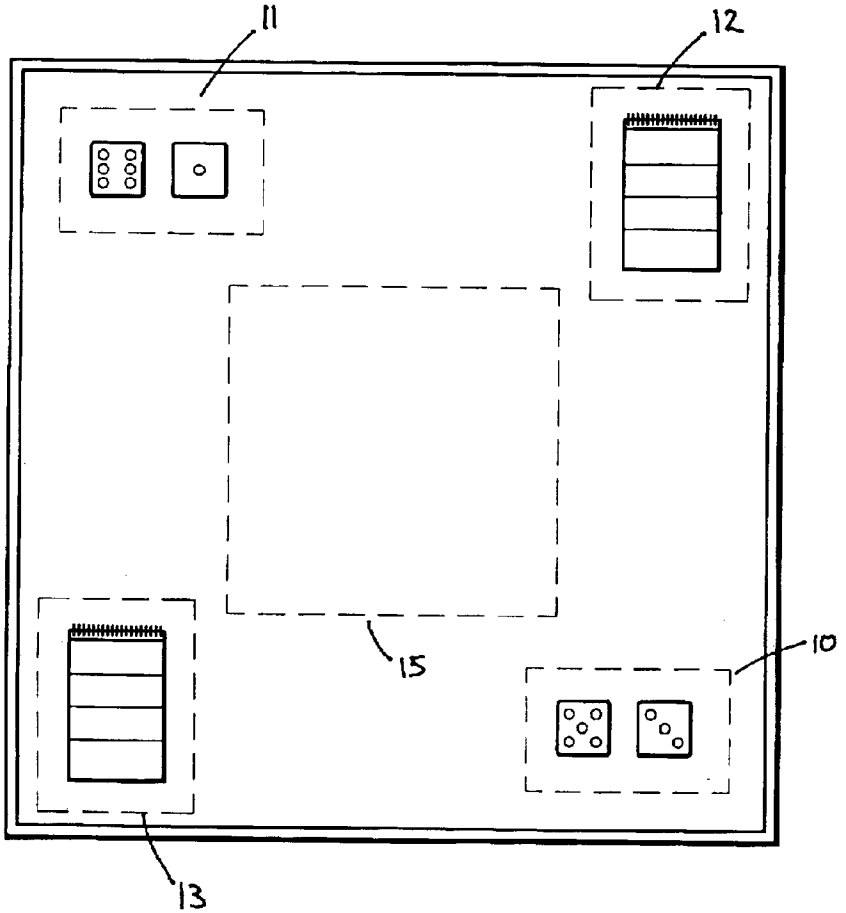

DICE GAME

DESCRIPTION OF RELATED ART

Many games among children are competitive and require knowledge of rules to win. A child starting to learn a game may become frustrated, as the child does not have knowledge of game rules. A younger child in early grade school may additionally lack a background in use of dice and scoring on a tally sheet.

Experienced children may take advantage of and bully less experienced children when playing board games. An inexperienced child may have a substantially lower chance of winning. What is desired is a simple game that allows an introduction of basic board game principles in a non-threatening environment, where experienced children may teach less experienced children regarding board games.

OBJECTS OF THE INVENTION

To provide a simple and fun game for children of all ages and teach younger children how to tally and count numbers. The game also offers an incentive for children to practice counting numbers.

DESCRIPTION OF THE DRAWINGS

FIG. 1. is a plan view of the game setup for two players.

FIG. 2. is the layout of the tally notepad.

DETAILED DESCRIPTION OF THE PREFERRED EMBODIMENT

Intended Players

The game of Joma is for 2 to 4 players of all age range.

Game Apparatus

Each player has two dice of a color that is unique to the player and a notepad used to tally dice rolls. The tally notepad is preprinted with numbers 1 to 6 (representing each possible dice roll) vertically on the left hand side of each sheet. A game board for two players is shown on figure one. The dice 10 for player one may be placed on the board, and the dice for player two may be placed on the board. The tally sheet for player one and 12 and the tally sheet for player two 13 may be placed on the board. A roll area defined on the board may be imprinted on the board as a rectangular area, or as a picture of a cartoon character, or other artwork.

Object of the Game

The goal of the game is to be the first player to gather 10 tally marks for all six possible dice rolls in each set of the game. Players continue to roll dice until this goal is reached. The first player to gather 10 tally marks is the winner of the set and receives a Joma—a token with an imprinted character. There are four sets in a game and the player with the most Jomas at the end of four sets wins the entire game. A tie score is resolved by a play-off set between all the players who hold equal number of tokens, or "Jomas". The single winner of the play-off set is the winner of the entire game.

Rules of the Game

Each player is provided with a set of two dice with a color (such as red and green) that is unique to the player and a tally notepad. A tally notepad is pad of paper upon which the tallied score is kept. The dice is a six face dice, with each face presenting a number between 1 to 6.

Each sheet of the tally notepad is preprinted with the player number and the color of dice for the respective players. The numbers 1 to 6 are listed below the title of each player, representing each possible dice roll.

A Round constitutes one series of dice rolling by every participating player.

A Set constitutes a series of rounds in which 10 tallies on each of the six numbers is obtained.

A Game constitutes a series of 4 Sets.

Each of the 4 sets begins with determining the order of each player by a dice roll. Each player rolls one dice once. The player with the higher dice roll precedes player(s) with lower dice rolls. The highest possible dice roll is 6 and the lowest possible is 1.

Any tie dice roll should be resolved as follows: If two players roll the same number, they will position themselves among other players with their current tie value. Thereafter these two players will roll the die once more to decide the order between them. The two players will then resume to the order where their original dice roll placed them.

After the order among all players has been established, each player will roll two dice simultaneously. The roll of the two dice will be accounted as two individual numbers (tally). For example, a dice roll of 2 and 3 will be recorded with a tally mark next to the number 2 and number 3, not the sum of the two numbers (as shown in FIG. 2).

Rule 1: At the beginning of each individual set, the first player is awarded two turns in the first round of the set.

Rule 2: If a player rolls a number that already has 10 tally marks, the player will lose a turn in the next round. The maximum amount of turns to be lost is 1, even if the player rolls two numbers that already have 10 tallies. Scenario 1: Player 1 already has 10 tally marks for the number 4. If player 1 gets a dice roll of 2 and 4, player 1 will add a tally mark to number 2 but not number 4, and will lose a turn in the next round. Scenario 2: Player 1 already has 10 tally marks for the number 4 and rolls two 4's. He will not add any tally marks to the number 4 and will lose a turn in the next round.

(Optional) Rule 2: If a player rolls a number that already has 10 tally marks, the player will lose a turn in the next round. If two numbers are rolled that already have ten tally marks then the player will lose his or her turn in the next two rounds. Scenario 1: Player 1 already has 10 tally marks for the number 4. If player 1 gets a dice roll of 2 and 4, player 1 will add a tally mark to number 2 but not number 4, and will lose a turn in the next round. Scenario 2: Player 1 already has 10 tally marks for the number 4 and rolls two 4's. He will not add any tally marks to the number 4 and will lose a turn in the next two rounds.

Rule 3: The player who rolls after a player has lost a turn will get an additional roll, even if it carries over into the next round. Scenario 1: Player 1 has 10 tally marks for the number 4. Player 1 gets a dice roll of 2 and 4. Player 2, who rolls after Player 1, will therefore get an extra roll in this round. Scenario 2: Player 4 has 10 tally marks for the number 4. Player 4 gets a dice roll of 2 and 4. Player 4 therefore will lose a turn in the next round, and Player 1 who begins the new round will gain an extra roll.

Rule 4: If a player, who has gained an extra roll, rolls a number that already has 10 tally marks, that player will lose his or her extra roll and his or her turn in the next round. Scenario: Player 2 has been awarded an extra roll because player 1 has lost a turn. Player 2 has 10 tally marks for the number 4. On the first roll, Player 2 gets a dice roll of 2 and 4. Player 2 will add a tally mark to the number 2, but will lose the extra roll and a turn in the next round.

Rule 5: If a player rolls a number that already has 10 tally marks on their extra turn, that player will lose a turn in the next round. Scenario: Player 2 has been awarded an extra roll because player 1 has lost a turn. Player 2 has 10 tally marks for the number 4. On the first roll, Player 2 gets a dice roll of 2 and 6. Player 2 will add a tally mark to the numbers 2 and 6. On the extra roll, Player 2 rolls a 2 and a 4. Player 2 will add tally to the number 2 but will lose a turn in the next round.

The foregoing describes the preferred embodiments of the invention. Modifications may be made without departing from the spirit and scope of the invention as set forth in the following claims.

Call Out List of Elements

10 Dice for Player
11 Dice for Player
12 Tally Sheet
13 Tally Sheet
15 Roll Area

What is claimed is:

1. A method for playing a dice game for 2 or more players comprising the steps of:

a. furnishing each player two six faced dice, b. furnishing a tally notepad for each player, the tally notepad preprinted with numbers 1 to 6 representing each possible dice roll vertically on the left hand side of each sheet, c. playing sets, each set beginning with determining the order of each player by a dice roll, wherein each player rolls one die once such that the player with a higher dice roll precedes players with a lower dice roll, wherein the highest possible dice roll is 6 and the lowest possible dice roll is 1, wherein a tie on a dice roll should be resolved as follows: if two players roll the same number, they will position themselves among other players with their current tie value, the two players rolling the die once more to decide the order between them, d. playing rounds, one series of dice rolling by every participating player, the first player being awarded two turns in the first round of each set, e. each player rolling two dice simultaneously, the roll of the two dice counted as two individual tallies of numbers, whereby, a dice roll of 2 and 3 will be recorded with a tally mark next to the number 2 and number 3, and not the sum of the two numbers, f. playing sets, a series of rounds where players seek 10 tallies on each of the six numbers, g. setting a max score of 10 tally marks for each set, players continue to roll dice until this goal is reached, wherein if a player rolls a number that already has 10 tally marks, the player will lose a turn in the next round, the maximum amount of turns to be lost is 1, even if the player rolls two numbers that already have 10 tallies, wherein the player who rolls after a player has lost a turn will get an additional roll, even if it carries over into the next round, wherein if a player, who has gained an extra turn, rolls a number that already has 10 tally marks, that player will lose his or her extra turn and his or her turn in the next round, wherein if a player rolls a number that already has 10 tally marks on their extra turn, that player will lose a turn in the next round.

h. giving a token to the first player to gather 10 tally marks for all six possible dice rolls in a set of the game, i. playing a series of 4 Sets, wherein a game has four sets, j. declaring the winner to be the player with the most tokens at the end of four sets, a tie score to be resolved by a play-off set between all the players who hold equal number of tokens, the single winner of the play-off set is the winner of the entire game.

2. The method of claim 1 for playing a dice game for at least 2 players wherein the dice color is unique to the player.

3. The method of claim 1 for playing a dice game for 2 to 4 players wherein the dice color and tally sheet match and are unique to the player.

4. The method of claim 1 for playing a dice game for 2 to 4 players wherein players continue to roll dice until the goal of 10 tally marks is reached, wherein if a player rolls a number that already has 10 tally marks, the player will lose a turn for each of the two die exceeding 10 tally marks, whereby if a player rolls a number matching one that already has 10 tally marks the player will lose a turn for each of the two die exceeding 10 tally marks, wherein a player may lose up to two turns.

5. The method of claim 1 for playing a dice game at least 2 players wherein players continue to roll dice until the goal of 10 tally marks is reached, wherein if a player rolls a number that already has 10 tally marks, the player will lose a turn for each of the two die exceeding 10 tally marks, whereby if a player rolls a number matching one that already has 10 tally marks the player will lose a turn for each of the two die exceeding 10 tally marks, wherein a player may lose up to two turns.

6. The method of claim 1 for playing a dice game for 2 to 4 players wherein if a player rolls a number that already has 10 tally marks, the player will lose may lose a maximum of only one turn.

* * * * *